US008808107B2

(12) United States Patent
Abe

(10) Patent No.: US 8,808,107 B2
(45) Date of Patent: Aug. 19, 2014

(54) GOLF CLUB

(75) Inventor: Hiroshi Abe, Kobe (JP)

(73) Assignee: SRI Sports Limited, Kobe (JP)

( * ) Notice: Subject to any disclaimer, the term of this patent is extended or adjusted under 35 U.S.C. 154(b) by 367 days.

(21) Appl. No.: 13/286,247

(22) Filed: Nov. 1, 2011

(65) Prior Publication Data

US 2012/0108359 A1 May 3, 2012

(30) Foreign Application Priority Data

Nov. 2, 2010 (JP) ..... 2010-246598

(51) Int. Cl.
*A63B 53/04* (2006.01)

(52) U.S. Cl.
CPC ..... *A63B 53/0466* (2013.01); *A63B 53/047* (2013.01)
USPC ..... 473/342; 473/345

(58) Field of Classification Search
CPC ..... A63B 53/0466; A63B 53/047
USPC ..... 473/324–350
See application file for complete search history.

(56) References Cited

U.S. PATENT DOCUMENTS

| | | | | |
|---|---|---|---|---|
| 4,280,700 | A * | 7/1981 | Plagenhoef | 473/289 |
| 6,926,618 | B2 * | 8/2005 | Sanchez et al. | 473/329 |
| 7,101,289 | B2 * | 9/2006 | Gibbs et al. | 473/329 |
| 7,137,907 | B2 * | 11/2006 | Gibbs et al. | 473/329 |
| 7,258,626 | B2 * | 8/2007 | Gibbs et al. | 473/329 |
| 7,422,528 | B2 * | 9/2008 | Gibbs et al. | 473/329 |
| 7,614,964 | B2 * | 11/2009 | Matsunaga | 473/342 |
| 7,618,331 | B2 * | 11/2009 | Hirano | 473/329 |
| 7,713,140 | B2 * | 5/2010 | Gibbs et al. | 473/329 |
| 7,993,214 | B2 * | 8/2011 | Hirano | 473/329 |
| 8,012,041 | B2 * | 9/2011 | Gibbs et al. | 473/329 |
| 8,070,623 | B2 * | 12/2011 | Stites et al. | 473/329 |
| 8,226,498 | B2 * | 7/2012 | Stites et al. | 473/329 |
| 8,376,876 | B2 * | 2/2013 | Gibbs et al. | 473/329 |
| 8,382,609 | B2 * | 2/2013 | Yokota | 473/346 |
| 8,469,834 | B2 * | 6/2013 | Wada et al. | 473/346 |
| 2010/0105501 | A1 * | 4/2010 | Wada et al. | 473/346 |

FOREIGN PATENT DOCUMENTS

| | | | | |
|---|---|---|---|---|
| JP | 10305121 | A * | 11/1998 | A63B 53/10 |
| JP | 2001046564 | A * | 2/2001 | A63B 53/10 |
| JP | 2012095855 | A * | 5/2012 | |
| JP | 2012139323 | A * | 7/2012 | |
| JP | 2012139410 | A * | 7/2012 | |

* cited by examiner

*Primary Examiner* — Alvin Hunter
(74) *Attorney, Agent, or Firm* — Birch, Stewart, Kolasch & Birch, LLP

(57) ABSTRACT

A golf club has a reverse flex of from 90 to 140 mm. In a front view of the golf club head under a standard state in which the golf club head is placed on a horizontal plane at its lie angle and loft angle, a first straight line drawn to pass through the centroid of the toe-crown-side thin portion and the centroid of the back surface of the face portion is inclined at an angle θA of from 30 to 40 degrees with respect to the horizontal plane; and a second straight line drawn to pass through the centroid of the heel-sole-side thin portion and the centroid of the back surface of the face portion is inclined at an angle θB of from 39 to 42 degrees with respect to the horizontal plane.

3 Claims, 9 Drawing Sheets

GOLF CLUB

BACKGROUND OF THE INVENTION

The present invention relates to a golf club having a specific combination of a reverse flex of the golf club and a thickness distribution of the face portion of a hollow golf club head capable of controlling decrease in the rebound performance on off-center hit.

In recent years, a hollow golf club head having a face portion comprising a central thick part and a thin part therearound has been proposed for example as disclosed in U.S. Patent Application Publication U.S.-2010-105501-A1.

In such a golf club head, owing to the thin surrounding part, it is possible to control the decrease in the rebound of the golf ball on off-center hit.

By the way, due to the structure of the golf club (a), the center G of gravity of the club head (b) is positioned at a certain distance from the center line (d) of the shaft (c). Accordingly, during down swing, due to the centrifugal force, the club head (b) moves closer to the swing plane. As a result, as shown in FIG. 10, the shaft (c) is bent, and the toe b1 of the club head (b) comes down (toward the ground) when compared with the position at address. Thus, so called toe-down is caused. With increase in the toe-down, the golf ball hitting positions vary wide in the toe-heel direction of the club face.

The present inventor, therefore, studied on the toe-down during down swing quantitatively in relation to the reverse flex of the club, and discovered that the decrease in the rebound performance on off-center hit can be minimized by specifically defining the thickness distribution of the face portion based on the reverse flex.

SUMMARY OF THE INVENTION

It is therefore, an object of the present invention to provide a golf club in which the decrease in the rebound of the golf ball on off-center hit can be minimized, and thereby it is possible to increase the carry distance of the golf ball.

According to the present invention, a golf club comprises a shaft, and a golf club head having a hollow structure and attached to the tip end of the shaft, wherein a reverse flex of the golf club is in a range of from 90 to 140 mm, and a face portion of the golf club head comprises a central thick portion including the centroid of the face portion, a toe-crown-side thin portion on the toe-side and on the crown-side of the central thick portion, and a heel-sole-side thin portion on the heel-side and on the sole-side of the central thick portion, wherein in a front view of the golf club head under a standard state in which the golf club head is placed on a horizontal plane at its lie angle and loft angle, a first straight line drawn to pass through the centroid of the toe-crown-side thin portion and the centroid of the back surface of the face portion is inclined at an angle θA of from 30 to 40 degrees with respect to the horizontal plane, and a second straight line drawn to pass through the centroid of the heel-sole-side thin portion and the centroid of the back surface of the face portion is inclined at an angle θB of from 39 to 42 degrees with respect to the horizontal plane.

In the present invention, since the golf club is provided with a reverse flex of 90 to 140 mm, in the case of a typical head speed range (40 to 47 m/s) of average golfers during down swing, the amount of the toe-down falls within a substantially fixed range. Therefore, the range of variations of the golf ball hitting positions can be predicted.

And in the present invention, by defining the angle θA and angle θB, the heel-sole-side thin portion and toe-crown-side thin portion are placed in the specific positions so that the thickness distribution becomes suitable for the predicted range of variations of the golf ball hitting positions caused by toe-down. As a result, the decrease in the rebound of the golf ball on off-center hit can be minimized.

In this application including the description and claims, sizes, positions, directions and the like relating to the club head refer to those under a standard state of the club head unless otherwise noted.

The standard state of the golf club 1 is such that the golf club head is placed on a horizontal plane HP so that the center line CL of the golf club shaft 2 is inclined at its lie angle alpha while keeping the center line CL on a vertical plane VP, and the club face 5 (at the sweet spot SS) forms its loft angle with respect to the horizontal plane HP.

The sweet spot SS is the point of intersection between the club face 5 and a straight line n drawn normally to the club face passing the center of gravity G of the head.

The front-back direction is a direction parallel with the straight line n projected on the horizontal plane HP.

The heel-and-toe direction is a direction parallel with the horizontal plane HP and perpendicular to the front-back direction.

The club length of the golf club is, as shown in FIG. 1, a length L measures along the center line CL of the club shaft 2 from the butt end 2*e* of the club shaft 2 to the intersecting point X of the center line CL of the club shaft 2 with the horizontal plane HP under the standard state.

The reverse flex Ry is, as shown in FIG. 4, the amount of deflection of the club measured at a point P1 on the grip side as a displacement in the vertical direction when the club 1 is supported at points S1 and S2 on the club head side so that the center line CL of the shaft 2 becomes parallel with the horizontal direction and a load W1 of 1.25 kgf is applied downwardly to the above-mentioned point P1, wherein the point S1 is positioned at 40 mm from the above-mentioned intersecting point X (shown in FIG. 1), the point S2 is positioned at 140 mm from the point S1, the point P1 is positioned at a distance Ld from the point S2, and the distance Ld is as follows:

club: distance Ld
driver: 860 mm
2-wood: 847 mm
3-wood: 835 mm
4-wood: 822 mm
5-wood: 809 mm
7-wood: 796 mm

DESCRIPTION OF THE PREFERRED EMBODIMENTS

Embodiments of present invention will now be described in detail in conjunction with accompanying drawings.

The golf club 1 according to the present invention comprises a shaft 2, a golf club head 3 attached to the tip end 2A of the shaft 2, and a grip 4 attached to the butt end 2B of the shaft 2.

Figure 1:
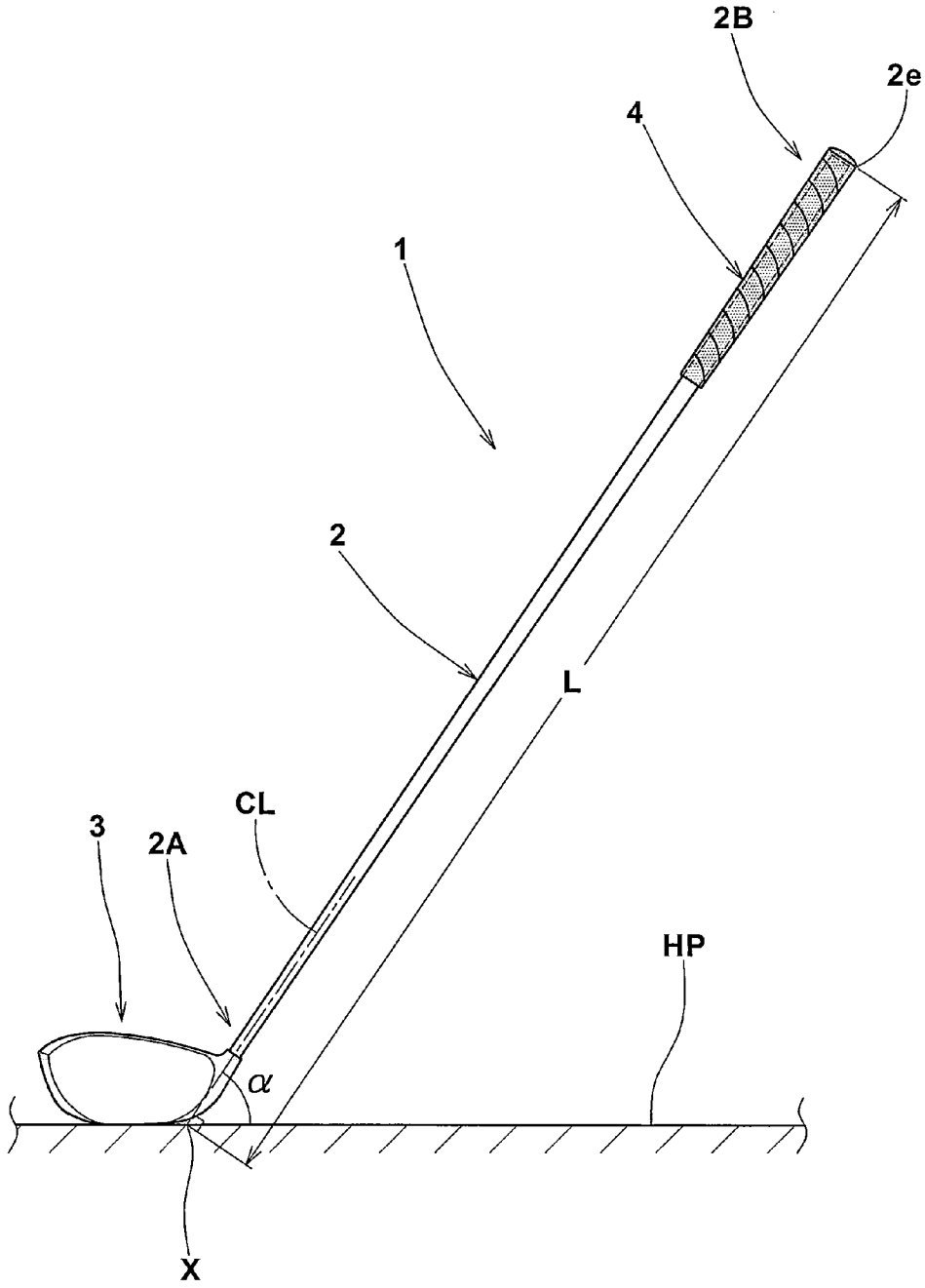
FIG. 1 is a front view of a golf club according to an embodiment of the present invention.
Figure 2:
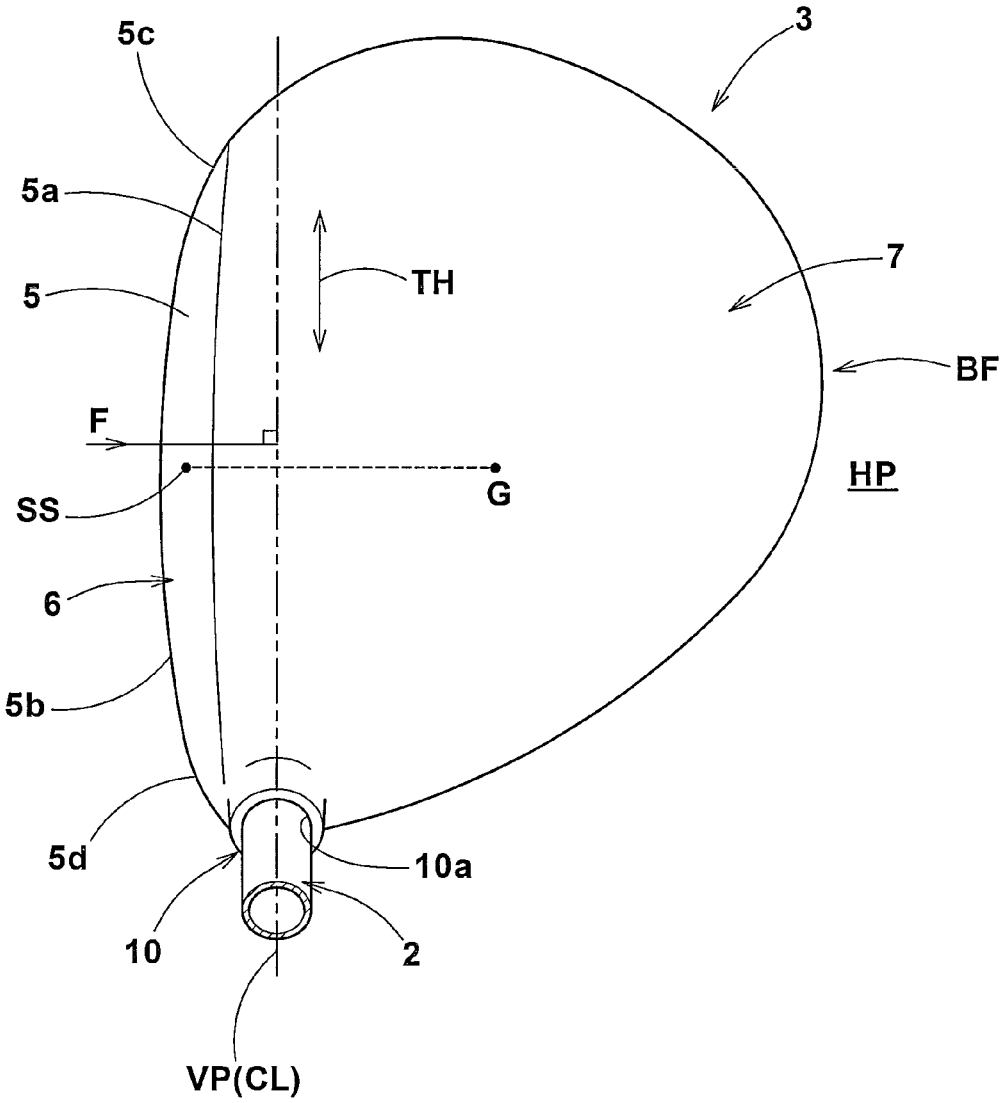
FIG. 2 is a top view of the golf club head thereof.

In this embodiment, as shown in FIG. 1 and FIG. 2, the golf club head 3 is formed as a wood-type golf club head such as for driver (#1), spoon (#3) and the like, and the loft angle is more than 0 degree, Preferably, the golf club 1 has a club length L of not less than 45 inches, more preferably not less than 45.5 inches, but not more than 47 inches, more preferably not more than 46.5 inches. If the club length L becomes more than 47 inches, it becomes difficult for the average golfers to achieve a good golf swing balance, and there is a tendency that variations of the golf ball hitting positions increase. If the club length L becomes less than 45 inches, the increasing of the head speed by the length of the club can not be fully expected.

The shaft 2 may be made of a metal material. In this embodiment, however, the shaft 2 is made of a fiber reinforced resin material in order to reduce the weight of the shaft 2 and thereby make it easier to swing through the golf ball. The use of a fiber reinforced resin material is preferred also in view of easiness in adjusting the weight balance, deflection and the like and flexibility in designing the shaft.

Figure 3:
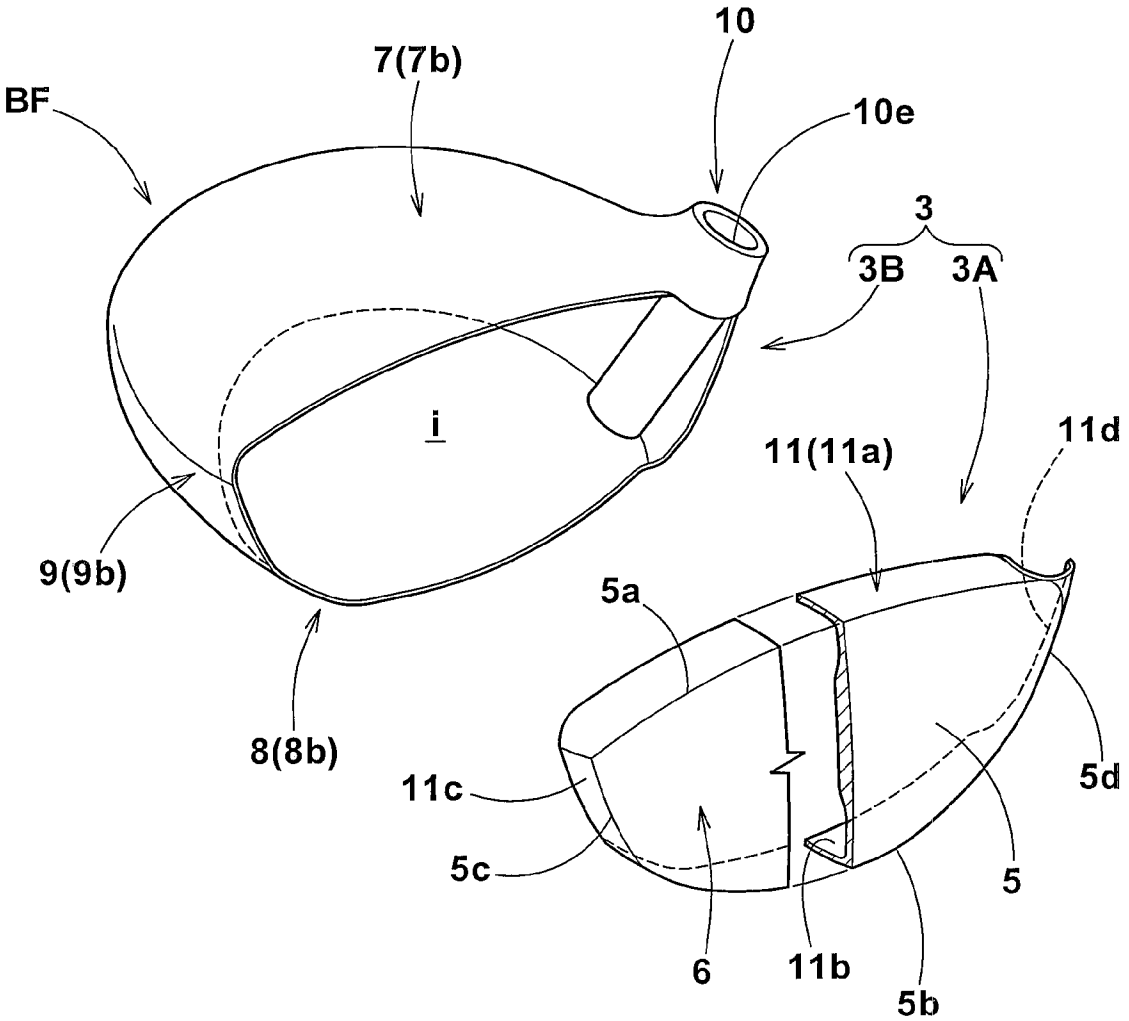
FIG. 3 is an exploded perspective view of the golf club head.
Figure 4:
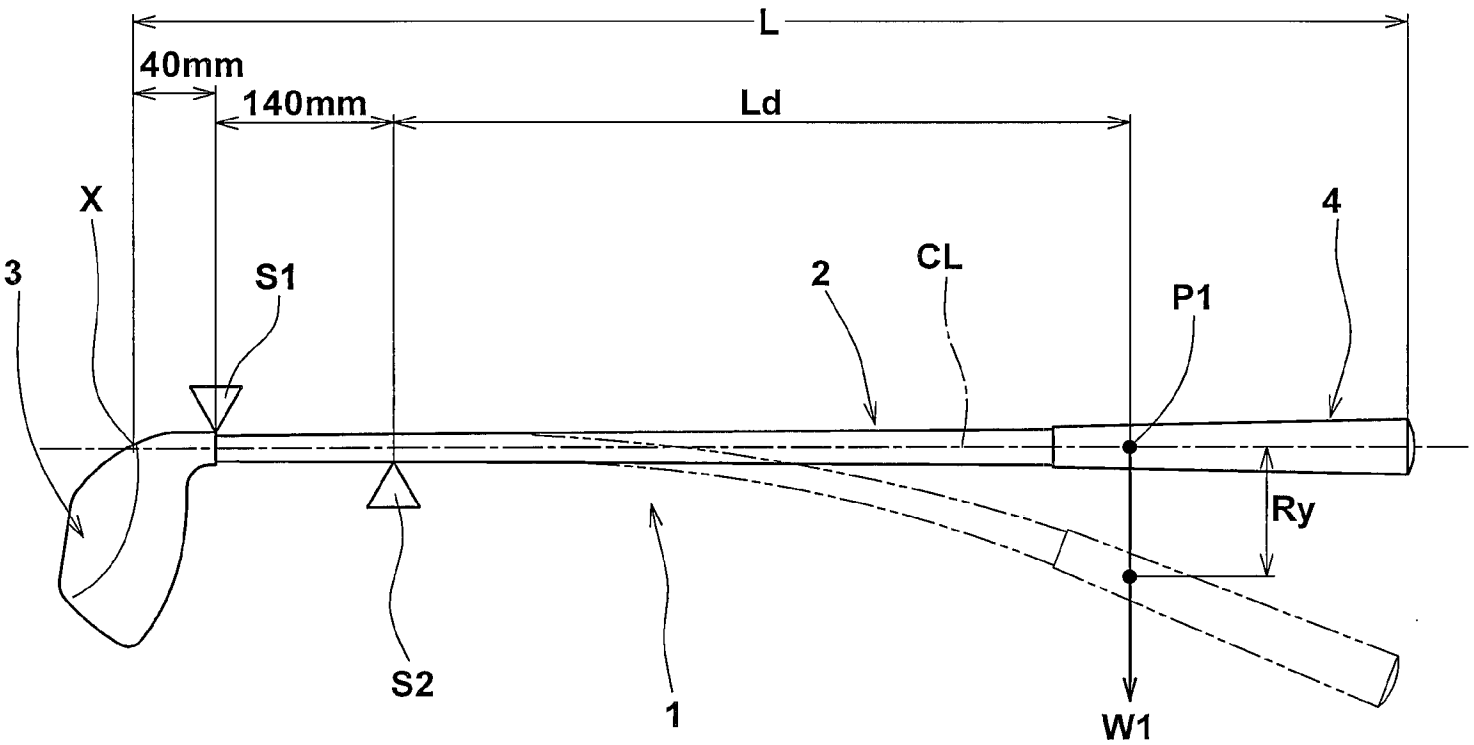
FIG. 4 is a diagram for explaining a method for measuring the reverse flex of a golf club.

As shown in FIGS. 2 and 3, the club head 3 comprises a face portion 6 of which front surface defines a club face 5 for striking the golf ball, a crown portion 7 defining the top surface of the club head intersecting the club face 5, a sole portion 8 defining the bottom face of the club head intersecting the club face 5, a side portion 9 between the crown portion 7 and sole portion 8 extending from the toe-side edge 5*c* of the club face 5 to the heel-side edge 5*b* of the club face 5 passing through the back face BF of the head, and a tubular hosel portion 10 having a shaft inserting hole 10*e* positioned on the heel-side of the crown portion 7.

Thus, the club head 3 is provided with a hollow (i) and a hollow shell structure with the thin wall.

The club head 3 in this embodiment is made of at least one kind of metal material.

In this embodiment, as shown in FIG. 3, the club head 3 has a two-piece structure composed of a head main body 3B provided with a front opening O and a face member 3A closing the front opening O and forming the face portion 6. However, the structure of the club head 3 is not limited to such a two-piece structure. For example, the club head 3 may be of a three or four piece structure.

As to the metal materials forming the face member 3A and the head main body 3B, for example, titanium alloys, stainless steels and the like can be used solo or in a combination of two or more kinds of metal materials. Further, a fiber reinforced resin material having a specific gravity smaller than the metal material(s) used may be used to form a part of the club head 3.

The face member 3A is made up of a face plate forming the entirety of the face portion 6, and a turnback 11 extending backward from the edges 5*a*-5*d* of the club face 5. The turnback 11 includes a crown-side turnback 11*a*, a sole-side turnback 11*b*, a toe-side turnback 11*c*, and a heel-side turnback 11*d*. In the face member 3A in this embodiment, the face plate and turnback 11 are integrally formed through press forming (plastic deformation) of a rolled metal material. Therefore, the head main body 3B forms a major aft part 7*b* of the crown portion 7, a major aft part 8*b* of the sole portion 8, a major aft part 9*b* of the side portion 9 and the hosel portion 10, excepting the part corresponding to the face member 3A. The head main body 3B in this embodiment is integrally molded by casting.

As another example of the club head structure, the turnback 11 can be omitted from the face member 3A. In other words, the face member 3A can be made up of the face plate only, and the front opening O of the head main body 3B is formed within the face portion.

Preferably, the club head 3 has a volume V of not less than 400 cc, more preferably not less than 410 cc, but not more than 470 cc, more preferably not more than 460 cc.

If the club head volume V becomes less than 400 cc, the sweet area is decreased. If the club head volume v becomes more than 470 cc, the mass of the club head is increased, and it becomes difficult to swing through the golf ball, and the head speed is decreased.

Preferably, the club head 3 has a mass of not less than 180 g, more preferably not less than 185 g, but not more than 210 g, more preferably not more than 200 g.

If the mass of the club head 3 is less than 180 g, as the kinetic energy of the club head decreases, it becomes difficult to increase the carry distance of the golf ball. If the mass of the club head 3 is more than 210 g, it becomes difficult to swing through the golf ball, and there is a tendency that the carry distance of the golf ball decreases.

Preferably, the grip 4 has a mass of 38 to 46 g. For example, the grip 4 is formed from a vulcanized rubber made from natural rubber, oil, carbon black, sulfur, zinc oxide and the like.

The present invention aims to control the decrease in the carry distance of the golf ball on off-center hits made at the head speed of about 40 to 47 m/s (namely, a typical head speed range of the average golfers). Based on this standpoint, the reverse flex Ry of the golf club 1 is set in a range of not less than 90 mm, preferably not less than 100 mm, but not more than 140 mm, preferably not more than 120 mm.

Figure 5A:
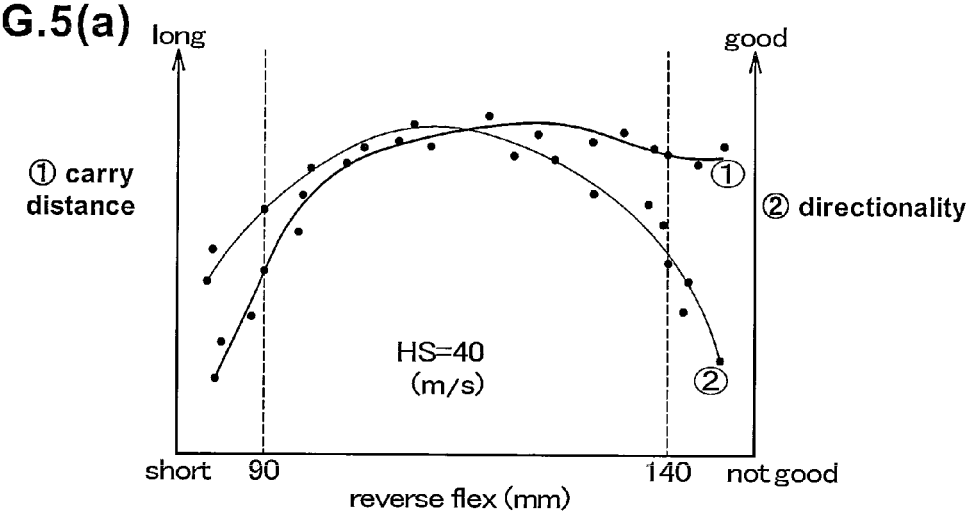
FIGS. 5(*a*)-5(*c*) are graphs showing the carry distance and directionality of the golf ball as a function of the reverse flex.
Figure 5B:
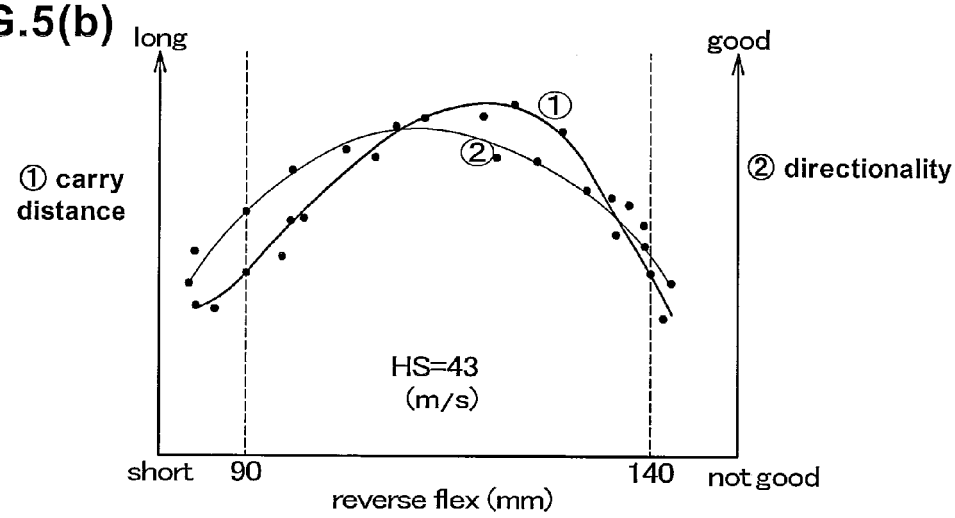
Figure 5C:
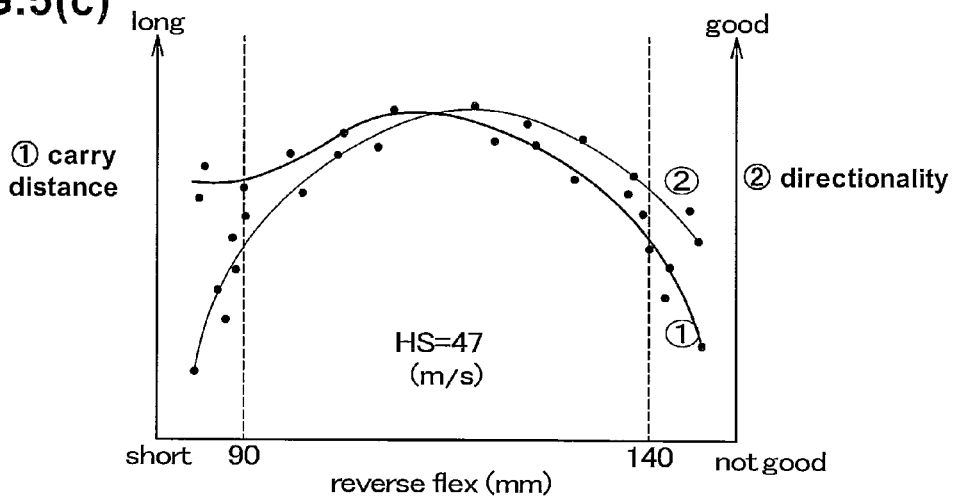

FIGS. 5(*a*)-5(*c*) show test results showing the carry distance and directionality of the golf balls as a function of the reverse flex Ry. (club length 47 inches, loft angle 11 degrees, club mass 300 g, head volume 455 cc, thickness of thick part of face portion 3.4 mm, thickness of thin parts of face portion 2.0 mm)

FIG. 5(*a*) shows test results of ten golfers each having an average head speed of 40 m/s.

FIG. 5(*b*) shows test results of ten golfers each having an average head speed of 43 m/s.

FIG. 5(*c*) shows test results of ten golfers reach having an average head speed of 47 m/s.

As apparent from these test results, if the reverse flex Ry is less than 90 mm, as the shaft 2 becomes rigid, it is difficult for the average golfers having such head speeds to bent the shaft 2 to obtain even a minimal required carry distance. Further, it becomes hard to return the club face 5 to its right position at impact, therefore, the directional stability of the golf balls become worse.

If the reverse flex Ry is more than 140 mm, as the shaft 2 becomes supple, it is difficult for the average golfers having such head speeds to stabilize the direction of the club face 5 at impact. As a result, the directional stability of the golf balls is decreased. Thus, in the present invention, the reverse flex Ry is optimized according to the head speed range of the average golfers so that it becomes possible to obtain the required carry distance and directionality.

Such reverse flex Ry can be adjusted within the above range by changing the kind of the material of the shaft 2, the elastic modulus of the material of the shaft 2 and the like.

When the average golfers use the golf club 1 whose reverse flex Ry is set in the above-mentioned range, the amounts of toe-down become within a substantially fix range, and the area to which the golf ball hitting positions spread is also fixed, therefore, by increasing the coefficient of restitution locally in this area, the decrease in the carry distance (rebound performance) on off-center hit can be minimized.

specifically, thin portions of the face portion 6 are arranged as follows.

Figure 6:
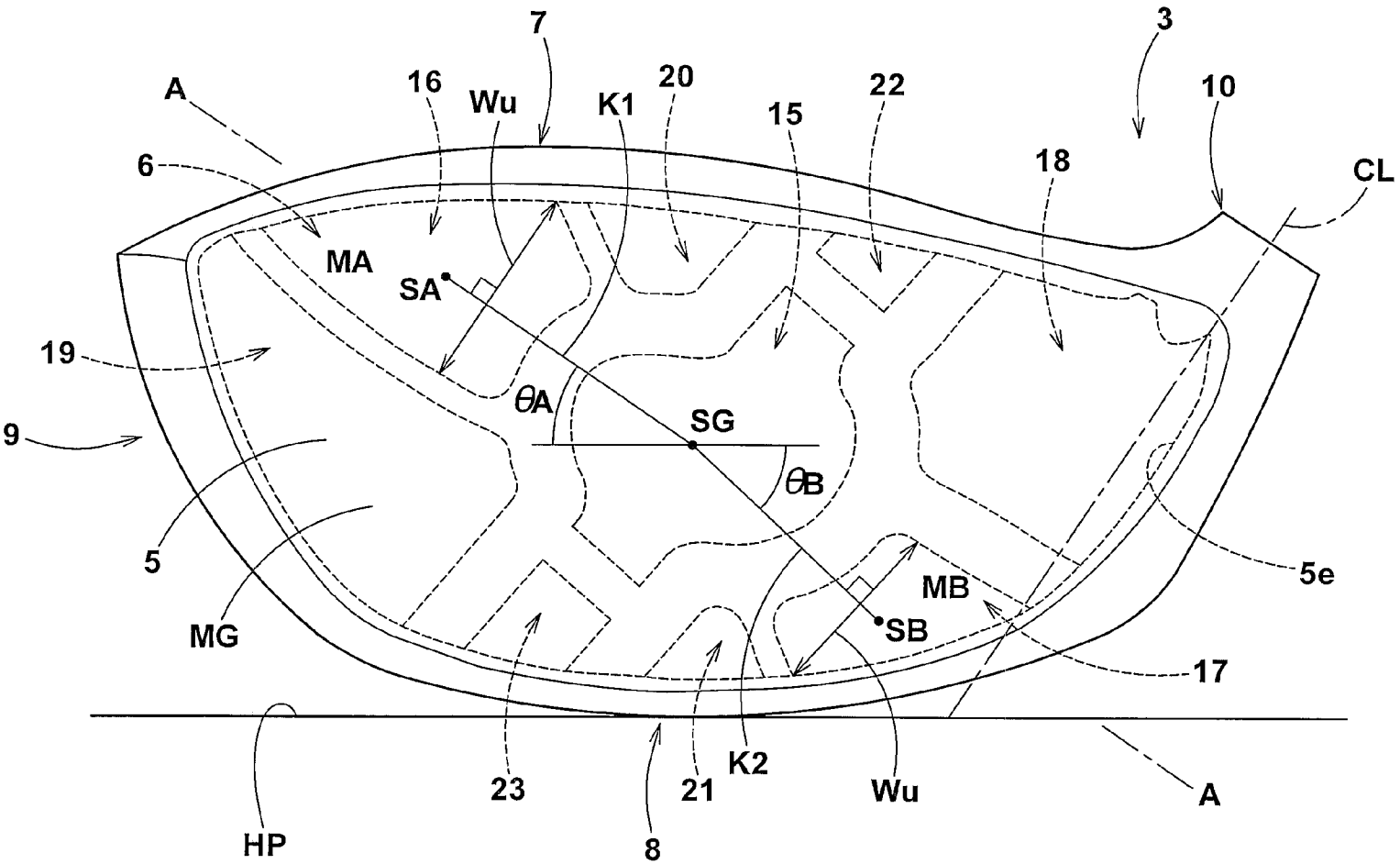
FIG. 6 is a front view of the golf club head.
Figure 7:
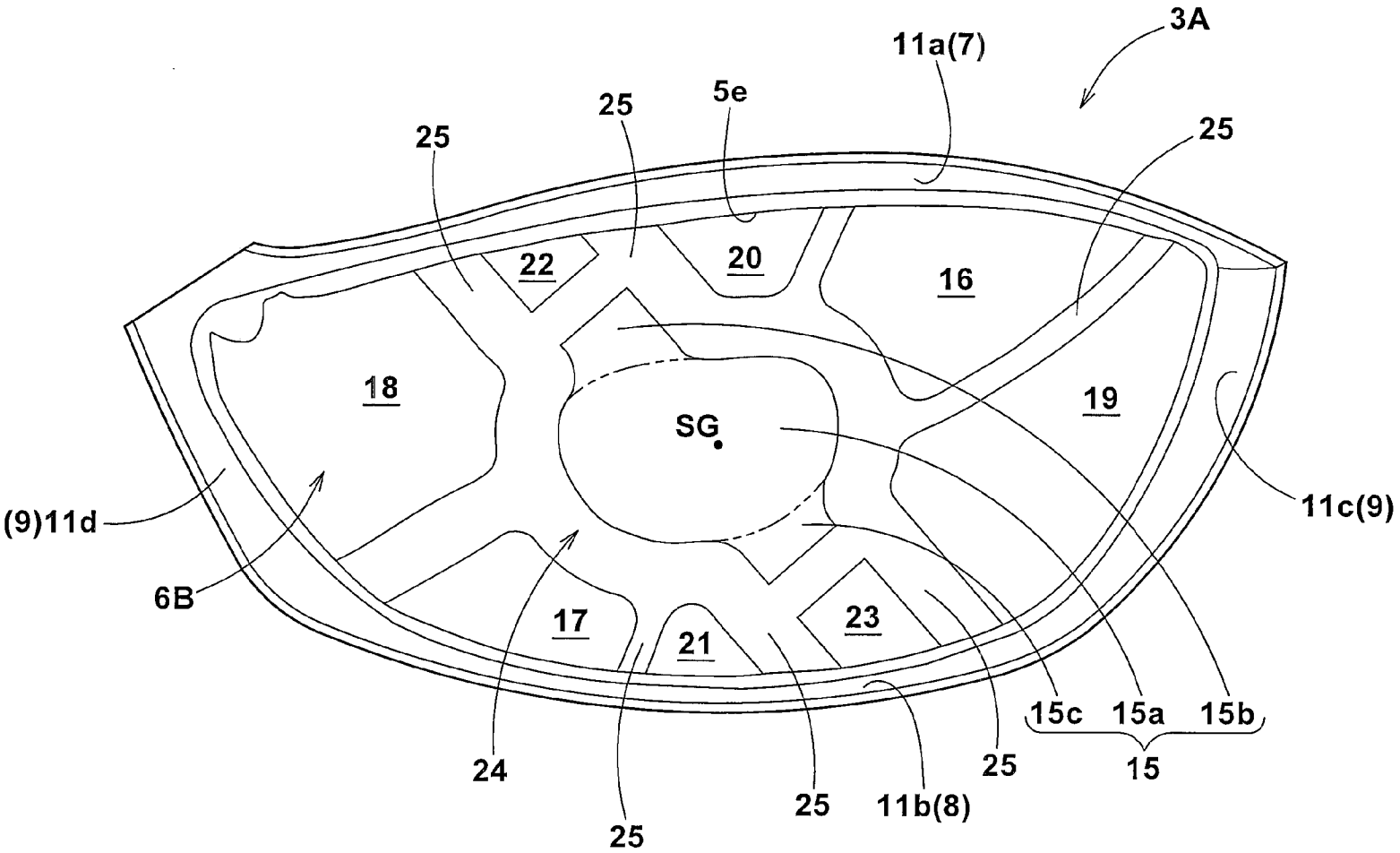
FIG. 7 is a rear view of a face member showing the back surface of the face portion.
Figure 8:
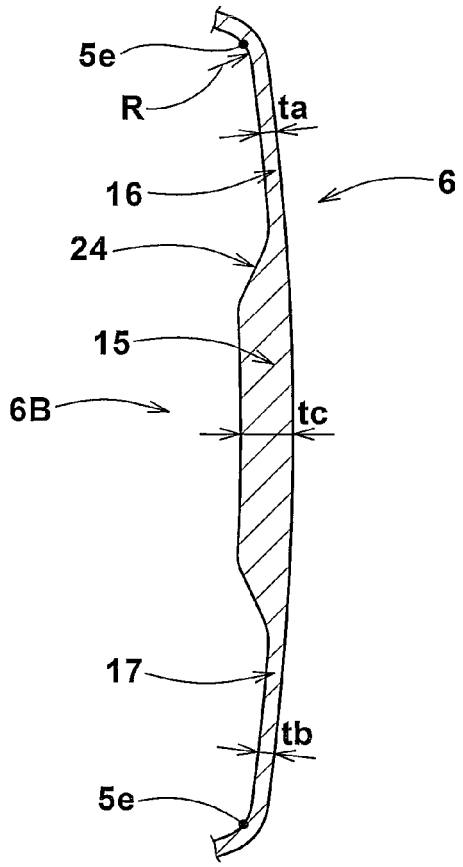
FIG. 8 is a cross sectional view taken along line A-A of FIG. 6.

As shown in FIGS. 6-8, in order to achieve the following special thickness distribution, the back surface 6B of the face portion 6 facing the hollow (i) is not flat, and the club face 5 is smooth, excepting club face grooves and punch marks (not shown) if any.

The face portion 6 is provided with a central thick portion 15, a toe-crown-side thin portion 16 on the toe-side and on the crown-side of the central thick portion 15, a heel-sole-side thin portion 17 on the heel-side and on the sole-side of the central thick portion 15, a heel-side middle thickness portion 18 on the heel-side of the central thick portion 15, a toe-side middle thickness portion 19 on the toe-side of the central thick portion 15, a crown-side middle thickness portion 20 on the crown-side of the central thick portion 15, a sole-side middle thickness portion 21 on the sole-side of the central thick portion 15, a crown-heel-side middle thickness portion 22 between the heel-side middle thickness portion 18 and crown-side middle thickness portion 20, and a sole-toe-side middle thickness portion 23 between the toe-side middle thickness portion 19 and sole-side middle thickness portion 21.

In order to improve the durability of the face portion 6, the central thick portion 15 has the largest thickness in the face portion 6.

In the front view of the club head, the central thick portion 15 includes the centroid SG of the club face 5, and does not extend to the peripheral edge 5*e* of the back surface 6B. The peripheral edge 5*e* of the back surface 6B is, as shown in FIGS. 7 and 8, the border line between the back surface 6B and {the inner surface of the crown portion 7, the inner surface of the sole portion 8 and the inner surface of the side portion 9}. If the border line is unclear because the corner between the back surface 6B and the inner surface of the portion 7, 8, 9 is rounded by an arc R, the peripheral edge 5*e* is considered as being located at the midpoint of the length of the arc R.

The central thick portion 15 is composed of a main part 15*a* having a round contour shape long in the toe-heel direction similarly to the contour shape of the back surface 6B, an upward part 15*b* extending toward the crown-heel-side middle thickness portion 22 from a heel-side upper part of the main part 15*a*, and a downward part 15*c* extending toward the sole-toe-side middle thickness portion 23 from a toe-side lower part of the main part 15*a*.

The upward part 15*b* and downward part 15*c* are formed along straight lines extending from the centroid SG of the club face 5 in almost parallel with the center line CL of the shaft.

The central thick portion 15 has a substantially constant thickness. Preferably, the thickness tc of the central thick portion 15 is set in a range of not less than 3.1 mm, more preferably not less than 3.2 mm, but not more than 3.7 mm, more preferably not more than 3.6 mm.

Preferably, the area MC of the central thick portion 15 is set in a range of not less than 5%, more preferably not less than 7%, but not more than 20%, more preferably not more than 15% of the area MG of the back surface 6B of the face portion 6.

The area MG of the back surface 6B somewhat depends on the volume of the club head 3, but the area MG is preferably set in a range of not less than 33 sq.cm, more preferably not less than 35 sq.cm, but not more than 53 sq.cm, more preferably not more than 47 sq.cm.

Here, the area of the back surface 6B of the face portion 6, the area of the central thick portion 15, and the area of each portion 16-23 are the areas projected on the vertical plane VP or a vertical plane parallel therewith.

If the thickness tc of the central thick portion 15 exceeds 3.7 mm, there is a tendency that the rebound of the golf ball becomes worse, and variations of the golf ball hitting positions increase.

The toe-crown-side thin portion 16 and the heel-sole-side thin portion 17 have the smallest thickness in the face portion 6, and the thickness is substantially constant all over these portions 16 and 17.

Therefore, on off-center hit, if the golf ball hits the thin portion, the face portion 6 is well deflected, and the decrease in the rebound can be minimized. Therefore, the decrease in the carry distance on off-center hit can be minimized.

Figure 9:
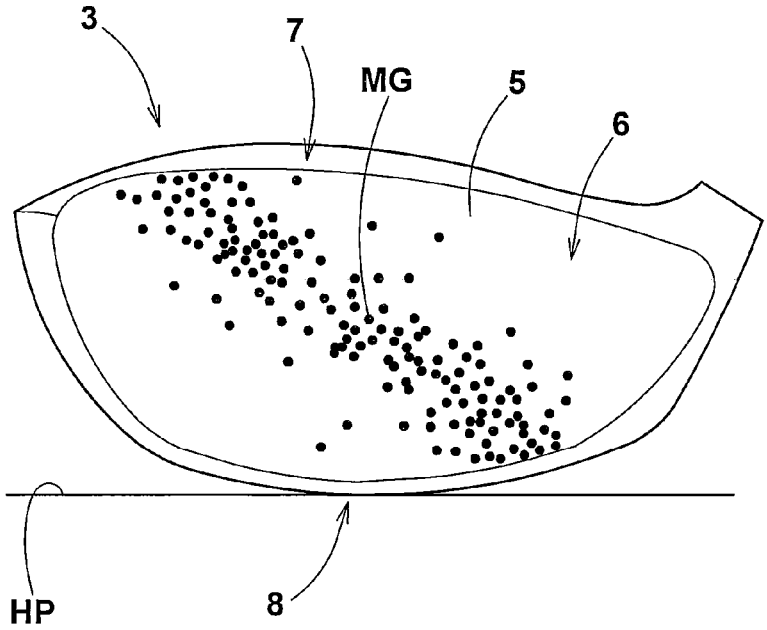
FIG. 9 is the front view of the golf club head showing an exemplary distribution of golf ball hitting positions of average golfers.
Figure 10:
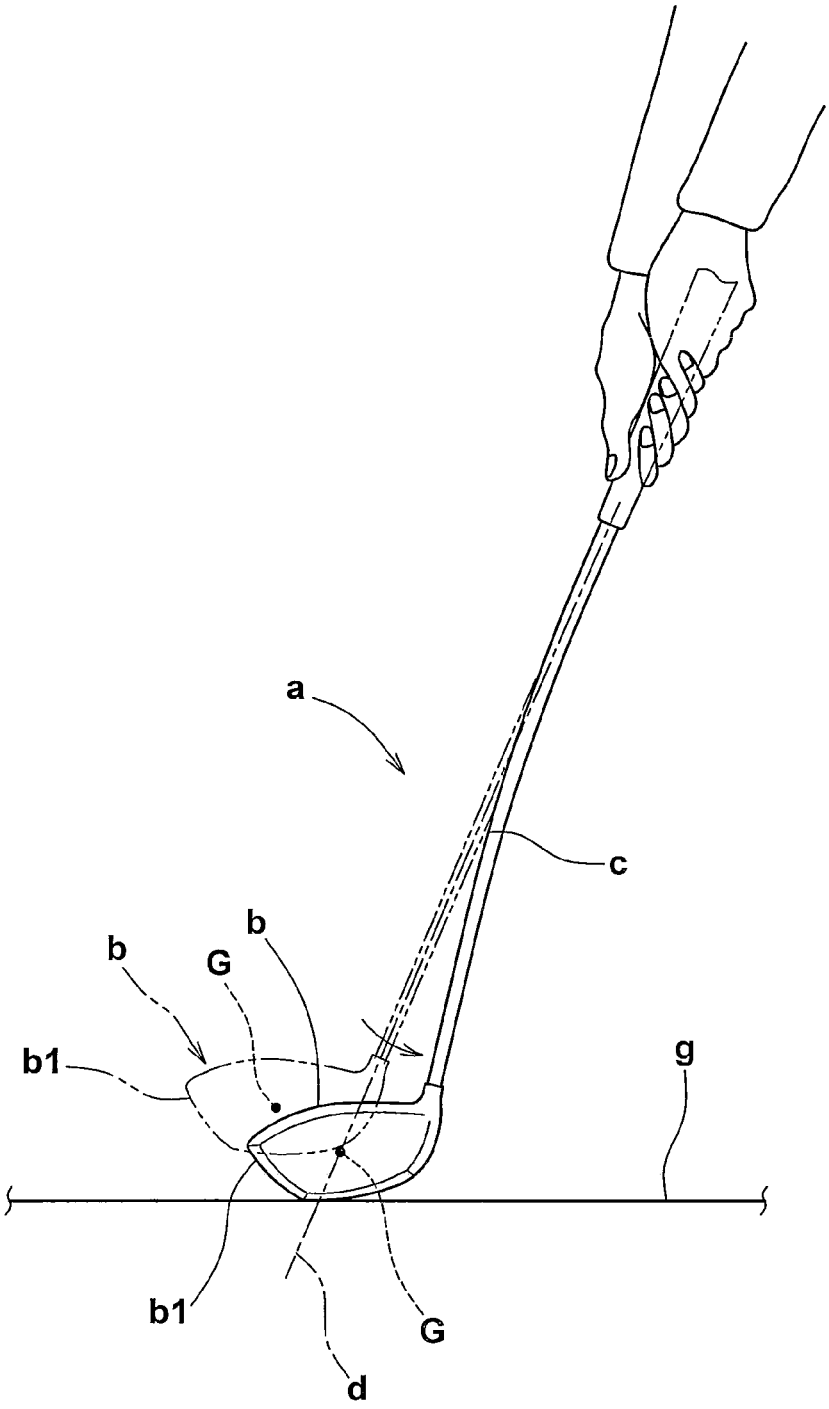
FIG. 10 is a front view of a golf club for explaining the toe-down.

When the average golfers use golf clubs having a reverse flex Ry of 90 to 130 mm, the amounts of toe-down fall in a fix range, and as a result, as shown in FIG. 9, the hitting positions concentrate along a line extending from the centroid SG of the back surface 6B toward the sole-heel-side in an angle range and a line extending from the centroid SG toward the crown-toe-side in an angle range. Accordingly, in the golf club 1 according to the present invention, in order to minimize the decrease in the rebound due to the variations of the golf ball hitting positions, the toe-crown-side thin portion 16 and heel-sole-side thin portion 17 are arranged to accord with the distribution of the golf ball hitting positions.

In the front view of the head under the standard state, as shown in FIG. 6, a first straight line K1 drawn to pass through the centroid SA of the toe-crown-side thin portion 16 and the centroid SG of the back surface 6B of the face portion 6 is inclined at an angle θA which is set in a range of not less than 30 degrees, preferably not less than 32 degrees, but not more than 40 degrees, preferably not more than 36 degrees with respect to the horizontal plane HP, and a second straight line K2 drawn to pass through the centroid SB of the heel-sole-side thin portion 17 and the centroid SG of the back surface 6B of the face portion 6 is inclined at an angle θB of which is set in a range of not less than 39 degrees, preferably not less than 40 degrees. but not more than 42 degrees, preferably not more than 41 degrees with respect to the horizontal plane HP. Here, the centroids SA, SB and SG are determined based on the areas MA, MB and MG.

If the angle θA is less than 30 degrees or more than 40 degrees or the angle θB is less than 39 degrees or more than 42 degrees, then the positions of the thin portions 16 and 17 do not match with the distribution of the golf ball hitting positions according to the amounts of toe-down. Thus, the rebound performance on off-center hit can not be improved.

If the toe-crown-side thin portion 16 and the heel-sole-side thin portion 17 become excessively thin, it is difficult to provide durability necessary for the club face 5. If excessively thick, there is a possibility that the rebound becomes insufficient. Therefore, the thickness to of the toe-crown-side thin portion 16 and the thickness tb of the heel-sole-side thin portion 17 are preferably set in a range of not less than 1.8 mm, more preferably not less than 1.9 mm, but not more than 2.4 mm, more preferably not more than 2.2 mm.

Incidentally, if grooves and/or punch marks are provided in the impact area, they are not considered in determining the thickness.

The area MA of the toe-crown-side thin portion 16 is preferably set in a range of not less than 6%, more preferably not less than 8%, but not more than 15%, more preferably not more than 12% of the area MG of the back surface 6B.

The area MB of the heel-sole-side thin portion 17 is preferably set in a range of not less than 3%, more preferably not less than 4%, but not more than 10%, more preferably not more than 8% of the area MG of the back surface 6B. Especially, it is preferable that the area MA of the toe-crown-side thin portion 16 is more than the area MB of the heel-sole-side thin portion 17.

If the area MA of the toe-crown-side thin portion 16 and the area MB of the heel-sole-side thin portion 17 become under the respective lower limits, there is a possibility that the rebound performance of the club head can not be improved fully. If exceed the respective upper limits, there is a possibility that the durability of the club head 3 deteriorates.

In this embodiment, the width of the toe-crown-side thin portion 16 measured perpendicularly to the first straight line K1, and the width of the heel-sole-side thin portion 17 measured perpendicularly to the second straight line K2 are gradually increased radially outward or toward the peripheral edge 5*e* of the back surface 6B in order to broaden the region which can control the decrease in the rebound of the golf ball on off-center hit.

Further, the maximum Wu of the width of the thin portion 16 and the maximum Wu of the width of the thin portion 17 are preferably set in a range of not less than 18 mm, more preferably not less than 20 mm, but not more than 26 mm, more preferably not more than 24 mm in order to achieve the rebound performance and the durability of the club face in a well balanced manner.

In order to achieve necessary durability for the face portion 6 while controlling unfavorable increase in the mass of the club head 3, the total area MS of the middle thickness portions 18-23 is preferably set in a range of not less than 32%, more preferably not less than 37%, but not more than 53%, more preferably not more than 48% of the area MG of the back surface 6B of the face portion 6.

And the thickness of each of the middle thickness portions 18-23 is preferably set in a range of not less than 45%, more preferably not less than 50%, but not more than 85%, more preferably not more than 80% of the thickness tc of the central thick portion 15.

In this embodiment, the thicknesses of the middle thickness portions 18-23 are as follows.

portion 22>portion 18>thin portion 17
portion 22>portion 20>thin portion 16
portion 23>portion 19>thin portion 16
portion 23>portion 21>thin portion 17

Therefore, the middle thickness portions 18-23 can make the rigidity change gradual and prevent stress concentration and thereby the durability of the face portion 6 can be effectively improved.

In this embodiment, the thick portion 15, thin portions 16 and 17 and middle thickness portions 18-23 each have substantially constant thickness. Therefore, a thickness transitional part is formed in order to make the thickness change more gradual between the adjacent portions 15-21.

The thickness transitional part includes a first thickness transitional part 24 extending continuously around the central thick portion 15 and having a thickness gradually decreasing from the central thick portion 15 toward the adjacent portions 16-23, and a plurality of (eight) second thickness transitional parts 25 extending radially from the first thickness transitional part 24 to the peripheral edge 5*e* of the back surface 6B passing through between the portions 16-23, and each having a thickness gradually changed from one of the thicknesses to the other of the adjacent portions 16-23.

In this embodiment, each of the second thickness transitional parts 25 has a substantially constant width. The first thickness transitional part 24 has almost constant width.

Comparison Tests

In order to confirm the effects of the present invention, wood-type golf club heads having specifications shown in Table 1 were prepared and attached to carbon shafts (SV-3003J, Flex S, manufactured by SRI sports Limited) so as to make wood clubs (driver) having club lengths of 45 to 47 inches. And the clubs were tested for the rebound performance.

Each of the golf club heads had a two-piece structure composed of a head main body made of Ti-6Al-4V and formed by a lost-wax precision casting technique, and a face member with a turnback made of Ti-6Al-4V and formed by a press molding technique, wherein the face member was welded to the head main body by a laser welding technique.

All of the wood-type golf club heads had the same specifications, except for the specifications shown in Table 1.

Common specifications are as follows.

lie angle alpha: 58 degrees
loft angle beta: 10.5 degrees
club head volume v: 455 cc
club head mass: 190 g
central thick portion's thickness tc: 3.4 mm
heel-sole-side thin portion's thickness tb: 2.0 mm
toe-crown-side thin portion's thickness ta: 2.0 mm
heel-side middle thickness portion's thickness: 73% of tc
toe-side middle thickness portion's thickness: 73% of tc
crown-side middle thickness portion's thickness: 65% of tc
sole-side middle thickness portion's thickness: 65% of tc
crown-heel-side middle thickness portion's thickness: 76.5% of tc
sole-toe-side middle thickness portion's thickness: 76.5% of tc
back surface area MG: 46.4 sq.cm
central thick portion's area MC: 11% of MG
toe-crown-side thin portion's area MA: 10.5% of MG
heel-sole-side thin portion's area MB: 5.5% of MG
total area of middle thickness portions MS: 43% of MG <Rebound Performance Test>

Each of ten testers (average golfers having head speeds ranging from about 40 to 47 m/s) hit golf balls ten times per each golf club which had a tester's choice of club length. With respect each club, the head speed HS just before the hitting and the initial speed BS of the golf ball were measured, and the average of speed ratios BS/Hs of the ten hits was calculated. The results are shown in Table 1 by an index based on the average of Ref. 1 being 100, wherein the larger the index number, the better the rebound performance.

The average head speeds of the testers and the club lengths used by the respective testers, are as follows.

| tester | average head speed (m/s) | club length (inch) |
|---|---|---|
| A | 40.5 | 45 |
| B | 41.2 | 46 |
| C | 42.3 | 45.5 |
| D | 42.7 | 45 |
| E | 43.5 | 46 |
| F | 43.6 | 46.5 |
| G | 44.2 | 47 |
| H | 44.8 | 45.5 |
| I | 45.6 | 47 |
| J | 46.8 | 46.5 |

average H.S.: average of ten swing

Incidentally, the golf balls used were commercially available three-piece golf balls "XXIO" manufactured by SRI Sports Limited.

From the test results, it was confirmed that the golf clubs according to the present invention can be improved in the rebound performance.

TABLE 1

| Club | Ref. 1 | Ref. 2 | Ref. 3 | Ref. 4 | Ref. 5 | Ex. 11 | Ex. 12 | Ex. 13 | Ref. 6 | Ref. 7 | Ex. 14 | Ex. 15 |
|---|---|---|---|---|---|---|---|---|---|---|---|---|
| reverse flex (mm) | 80 | 80 | 80 | 90 | 90 | 90 | 90 | 90 | 90 | 90 | 90 | 90 |
| angle θA (deg.) | 30 | 35 | 40 | 35 | 28 | 30 | 35 | 40 | 42 | 28 | 30 | 35 |
| angle θB (deg.) | 40 | 40 | 40 | 38 | 39 | 39 | 39 | 39 | 39 | 40.5 | 40.5 | 40.5 |
| rebound performance | 1.38 | 1.35 | 1.35 | 1.36 | 1.41 | 1.44 | 1.42 | 1.42 | 1.35 | 1.36 | 1.41 | 1.43 |

| Club | Ex. 16 | Ref. 8 | Ref. 9 | Ex. 17 | Ex. 18 | Ex. 19 | Ref. 10 | Ref. 11 | Ref. 12 | Ref. 13 | Ex. 110 |
|---|---|---|---|---|---|---|---|---|---|---|---|
| reverse flex (mm) | 90 | 90 | 90 | 90 | 90 | 90 | 90 | 90 | 115 | 115 | 115 |
| angle θA (deg.) | 40 | 42 | 28 | 30 | 35 | 40 | 42 | 35 | 35 | 28 | 30 |
| angle θB (deg.) | 40.5 | 40.5 | 42 | 42 | 42 | 42 | 42 | 43 | 38 | 39 | 39 |
| rebound performance | 1.42 | 1.37 | 1.38 | 1.41 | 1.42 | 1.41 | 1.37 | 1.36 | 1.38 | 1.36 | 1.42 |

| Club | Ex. 111 | Ex. 112 | Ref. 14 | Ref. 15 | Ex. 113 | Ex. 114 | Ex. 115 | Ref. 16 | Ref. 17 | Ex. 116 | Ex. 117 |
|---|---|---|---|---|---|---|---|---|---|---|---|
| reverse flex (mm) | 115 | 115 | 115 | 115 | 115 | 115 | 115 | 115 | 115 | 115 | 115 |
| angle θA (deg.) | 35 | 40 | 42 | 28 | 30 | 35 | 40 | 42 | 28 | 30 | 35 |
| angle θB (deg.) | 39 | 39 | 39 | 40.5 | 40.5 | 40.5 | 40.5 | 40.5 | 42 | 42 | 42 |
| rebound performance | 1.43 | 1.42 | 1.38 | 1.37 | 1.43 | 1.44 | 1.43 | 1.38 | 1.38 | 1.42 | 1.43 |

| Club | Ex. 118 | Ref. 18 | Ref. 19 | Ref. 20 | Ref. 21 | Ex. 119 | Ex. 120 | Ex. 121 | Ref. 22 | Ref. 23 | Ex. 122 |
|---|---|---|---|---|---|---|---|---|---|---|---|
| reverse flex (mm) | 115 | 115 | 115 | 140 | 140 | 140 | 140 | 140 | 140 | 140 | 140 |
| angle θA (deg.) | 40 | 42 | 35 | 35 | 28 | 30 | 35 | 40 | 42 | 28 | 30 |
| angle θB (deg.) | 42 | 42 | 43 | 38 | 39 | 39 | 39 | 39 | 39 | 40.5 | 40.5 |
| rebound performance | 1.42 | 1.37 | 1.36 | 1.37 | 1.37 | 1.41 | 1.42 | 1.41 | 1.37 | 1.36 | 1.41 |

| Club | Ex. 123 | Ex. 124 | Ref. 24 | Ref. 25 | Ex. 125 | Ex. 126 | Ex. 127 | Ref. 26 | Ref. 27 | Ref. 28 | Ref. 29 |
|---|---|---|---|---|---|---|---|---|---|---|---|
| reverse flex (mm) | 140 | 140 | 140 | 140 | 140 | 140 | 140 | 140 | 140 | 150 | 150 |
| angle θA (deg.) | 35 | 40 | 42 | 28 | 30 | 35 | 40 | 42 | 35 | 30 | 40 |
| angle θB (deg.) | 40.5 | 40.5 | 40.5 | 42 | 42 | 42 | 42 | 42 | 43 | 40 | 40 |
| rebound performance | 1.42 | 1.41 | 1.38 | 1.39 | 1.40 | 1.41 | 1.41 | 1.38 | 1.39 | 1.38 | 1.37 |

The invention claimed is:

1. A golf club comprising a shaft, and a golf club head having a hollow structure and attached to the tip end of the shaft, wherein a reverse flex of the golf club is in a range of from 90 to 140 mm, and a face portion of the golf club head comprises a central thick portion including the centroid of the face portion, a toe-crown-side thin portion on the toe-side and on the crown-side of the central thick portion, said toe-crown-side thin portion having an area in a range of from 6% to 15% of the area of the back surface of the face portion, and a heel-sole-side thin portion on the heel-side and on the sole-side of the central thick portion, said heel-sole-side thin portion having an area in a range of from 3% to 10% of the area of the back surface of the face portion, wherein the thickness of the toe-crown-side thin portion and the thickness of the heel-sole-side thin portion are in a range of from 1.8 to 2.4 mm, and wherein in a front view of the golf club head under a standard state in which the golf club head is placed on a horizontal plane at its lie angle and loft angle, a first straight line drawn to pass through the centroid of the toe-crown-side thin portion and the centroid of the back surface of the face portion is inclined at an angle θA of from 30 to 40 degrees with respect to the horizontal plane, and a second straight line drawn to pass through the centroid of the heel-sole-side thin portion and the centroid of the back surface of the face portion is inclined at an angle θB of from 39 to 42 degrees with respect to the horizontal plane.

2. The golf club according to claim 1, wherein the volume of the golf club head is in a range of from 400 to 470 cc.

3. The golf club according to claim 1, wherein the golf club head is of a wood-type.

* * * * *